US010371431B2

(12) United States Patent
Seo

(10) Patent No.: US 10,371,431 B2
(45) Date of Patent: Aug. 6, 2019

(54) REFRIGERATION WITH AIR PURIFICATION

(71) Applicant: LG ELECTRONICS INC., Seoul (KR)

(72) Inventor: Hyunwoo Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 95 days.

(21) Appl. No.: 15/398,798

(22) Filed: Jan. 5, 2017

(65) Prior Publication Data

US 2017/0191728 A1 Jul. 6, 2017

(30) Foreign Application Priority Data

Jan. 5, 2016 (KR) ..... 10-2016-0001258

(51) Int. Cl.
*F25D 17/04* (2006.01)

(52) U.S. Cl.
CPC .... *F25D 17/042* (2013.01); *F25D 2317/0417* (2013.01)

(58) Field of Classification Search
CPC ..... F25D 17/042; F25D 17/065; F25D 2317/0417; F25D 2317/063; F25D 23/065; F25D 29/00
See application file for complete search history.

(56) References Cited

U.S. PATENT DOCUMENTS 6,967,008 B1 * 11/2005 Barnes ..... A01M 29/12 422/121
7,641,707 B2 * 1/2010 Kang ..... B01D 46/0006 55/385.1
2002/0162346 A1 * 11/2002 Chiang ..... A47F 3/0447 62/246
2006/0218961 A1 * 10/2006 Kim ..... B67D 1/0858 62/344
2007/0251812 A1 * 11/2007 Hayman, Jr. ..... A61L 9/20 204/157.15
2008/0168788 A1 * 7/2008 Hurlebaus ..... F25D 17/042 62/271
2008/0168790 A1 * 7/2008 Hurlebaus ..... A61L 9/205 62/331
2009/0280027 A1 * 11/2009 Hayman, Jr. ..... A61L 9/205 422/4
2012/0260683 A1 * 10/2012 Cheon ..... F25D 29/00 62/125

(Continued)

FOREIGN PATENT DOCUMENTS

JP S62261879 A 11/1987
JP 2004-325039 11/2004
JP 2012093090 5/2012

(Continued)

*Primary Examiner* — Henry T Crenshaw
(74) *Attorney, Agent, or Firm* — Fish & Richardson P.C.

(57) ABSTRACT

The present disclosure relates to a refrigerator including: a cabinet that has a storage space formed therein; a grill pan that defines a rear wall surface of the storage space; a purification device that is mounted on the grill pan to suck and purify air within the storage space; and a duct unit in which a cold air passage that is formed on a rear side of the grill pan to guide cold air of an evaporator to the storage space and a purification passage that guides the air purified by the purification device to the storage space again.

16 Claims, 6 Drawing Sheets

(56) References Cited

U.S. PATENT DOCUMENTS

2013/0015753 A1* 1/2013 Son ..... F25D 29/00
312/405

FOREIGN PATENT DOCUMENTS

| | | | |
|---|---|---|---|
| KR | 10-2005-0108828 | | 11/2005 |
| KR | 10-2006-0106051 | | 10/2006 |
| KR | 10-2012-0075825 | | 7/2012 |
| KR | 2012097550 | A | 9/2012 |
| KR | 10-2008-0079109 | | 4/2014 |
| KR | 10-2014-0101629 | | 8/2014 |

* cited by examiner

REFRIGERATION WITH AIR PURIFICATION

CROSS-REFERENCE TO RELATED APPLICATIONS

This application claims priority to Korean Patent Application No. 10-2016-0001258 filed on Jan. 5, 2016 in Korea, the entire contents of which is hereby incorporated by reference in its entirety.

TECHNICAL FIELD

The present disclosure relates to a refrigerator.

BACKGROUND

In general, a refrigerator, which is a home appliance that may store foods in a storage space therein shielded by a door at a low temperature, is configured to store stored foods in an optimum state by cooling an inside of a storage space using cold air generated through heat exchange with a refrigerant circulating in a refrigerating cycle.

Such a refrigerator tends to be enlarged and multi-functioned due to a change in dietary habits and diversification of tastes of a user, and refrigerators having various structures and convenience equipment mounted thereon for user's convenience and freshness of stored foods have been released.

Meanwhile, odor occurs in the interior of the refrigerator by the stored foods. The type and the density of the odor are changed in accordance with the type and freshness of the stored foods, and a user feels displeasure in accordance with the type and the density of the odor. Further, when foods that generate a large amount of odor are stored, the odor affects textures of other foods.

Further, air within the refrigerator is polluted due to introduction of external air when the door is opened and then closed. That is, decomposition of foods may be promoted due to bacteria included in the external air or the foods may be polluted due to dusts. When the foods are decomposed or polluted, odor that is generated in the foods gets worse, and thus provides larger inconvenience to the user.

To solve the above-described problems, a system for purifying the air within the refrigerator is required.

Meanwhile, when cold air introduced into the refrigerator is purified through a cold air generating room having an evaporator, there is problems in that it is impossible to purify the air within the refrigerator while the cold air is not supplied to the inside of the cold air generating room, and when the air is consistently purified, a storage state of foods becomes bad because the inside of the refrigerator is excessively cooled as air cooled by the evaporator is consistently supplied to the inside of the refrigerator.

SUMMARY

An aspect of the present disclosure is to provide a refrigerator that includes a purification passage and a purification device for purifying air within a storage space, wherein the purification passage is formed separately from a cold air passage for supplying cold air, so that the air within the storage space may be independently and effectively purified.

An aspect of the present disclosure is to provide a refrigerator in which when a purification passage through which air purified by a purification device moves is formed, the purification passage is formed together with a duct unit that defines a cold air passage, so that a space for formation of the purification passage may be minimized.

A refrigerator according to an embodiment of the present disclosure includes: a cabinet in which a storage space is formed; a grill pan that defines a rear wall surface of the storage space; a purification device that is mounted on the grill pan to suck and purify air within the storage space; and a duct unit in which a cold air passage that is formed on a rear side of the grill pan to guide cold air of an evaporator to the storage space and a purification passage that guides the air purified by the purification device to the storage space again are independently formed.

A purification device mounting port is formed in the grill pan and a purification device mounting part that communicates with the purification passage and accommodates at least a portion of the purification device is formed in the duct unit corresponding to the purification device mounting port.

The duct unit may include: a purification duct that is arranged at a center of the grill pan to define the purification passage; and cold air ducts that are arranged on opposite sides of the purification duct to define the cold air passage.

Cold air discharge ports that communicate with the cold air duct to discharge cold air and purification discharge ports that communicate with the purification duct to discharge purified air are formed in the grill pan. The cold air discharge ports may be arranged on opposite sides of the purification discharge ports.

The pair of cold air ducts may be arranged on a more outer side of the cold air discharge ports to be spaced apart from each other so as to define the cold air passage, and the purification duct may be arranged between the pair of cold air discharge ports.

The duct unit may include: a duct panel to which the grill pan is mounted on a rear side of the grill pan; and a duct cover that is spaced apart from the duct panel, wherein the purification duct and the cold air ducts are arranged between the duct panel and the duct cover to define the cold air passage and the purification passage.

The purification passage may be formed by coupling a purification passage part that communicates with the purification device and is recessed in the purification duct and the duct cover that is coupled to a rear surface of the purification duct.

The duct unit may further include an air guide that is coupled to the purification duct on a rear side of the purification device and is recessed such that air passing through the purification device is guided toward the purification passage part.

The duct unit may further include a heat insulating member that is formed to have a shape corresponding to a front surface of the cold air passage and is arranged on a rear side of the grill pan to insulate the cold air passage.

An evaporator that evaporates cold air is located on a rear side of the grill pan. A cold air fan assembly that forcibly blows the cold air of the evaporator to the cold air passage may further formed on the rear side of the grill pan.

The purification duct may extend to the cold air fan assembly to guide the cold air such that the cold air flows to the cold air passage on opposite sides thereof.

Centers of the grill pan and the duct unit may be recessed in a shape corresponding to a mounting member holder such that the mounting member holder for mounting a shelf is mounted thereon.

The purification passage may be branched to bypass the mounting member holder.

The purification device may include: a purification fan that sucks air within the storage space and moves the sucked air to the purification passage; a purification filter that is formed in front of the purification fan and purifies the air sucked by the purification fan; and a purification device cover that is formed in front of the purification filter and covers the purification fan and the purification filter.

The purification device cover may be formed on an outer surface of the grill pan and purification suction ports through which the air within the storage space is sucked may be perforated on a side circumference of the grill pan.

The purification filter may include an ultraviolet light emitting diode (LED) that is arranged between the purification filter and the purification fan to cross the purification fan and sterilizes the air sucked by the purification fan.

The purification device may further include a sensor that measures a pollution degree of the air within the storage space.

The purification fan may be controlled to be operated when the pollution degree of the air, which is measured by the sensor, is not less than a predetermined reference value.

The purification fan may be controlled to be operated at a specific time interval.

The purification device may be located at an upper end of the grill pan to purify the air within the storage space and then downward discharge the purified air, and a cold air fan assembly that blows the cold air of the evaporator may be located at a lower end of the grill fan to discharge the cold air from a lower side to an upper side thereof.

BRIEF DESCRIPTION OF THE DRAWINGS

The present invention will become more fully understood from the detailed description given herein below and the accompanying drawings, which are given by illustration only, and thus are not limitative of the present invention, and wherein.

DETAILED DESCRIPTION

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
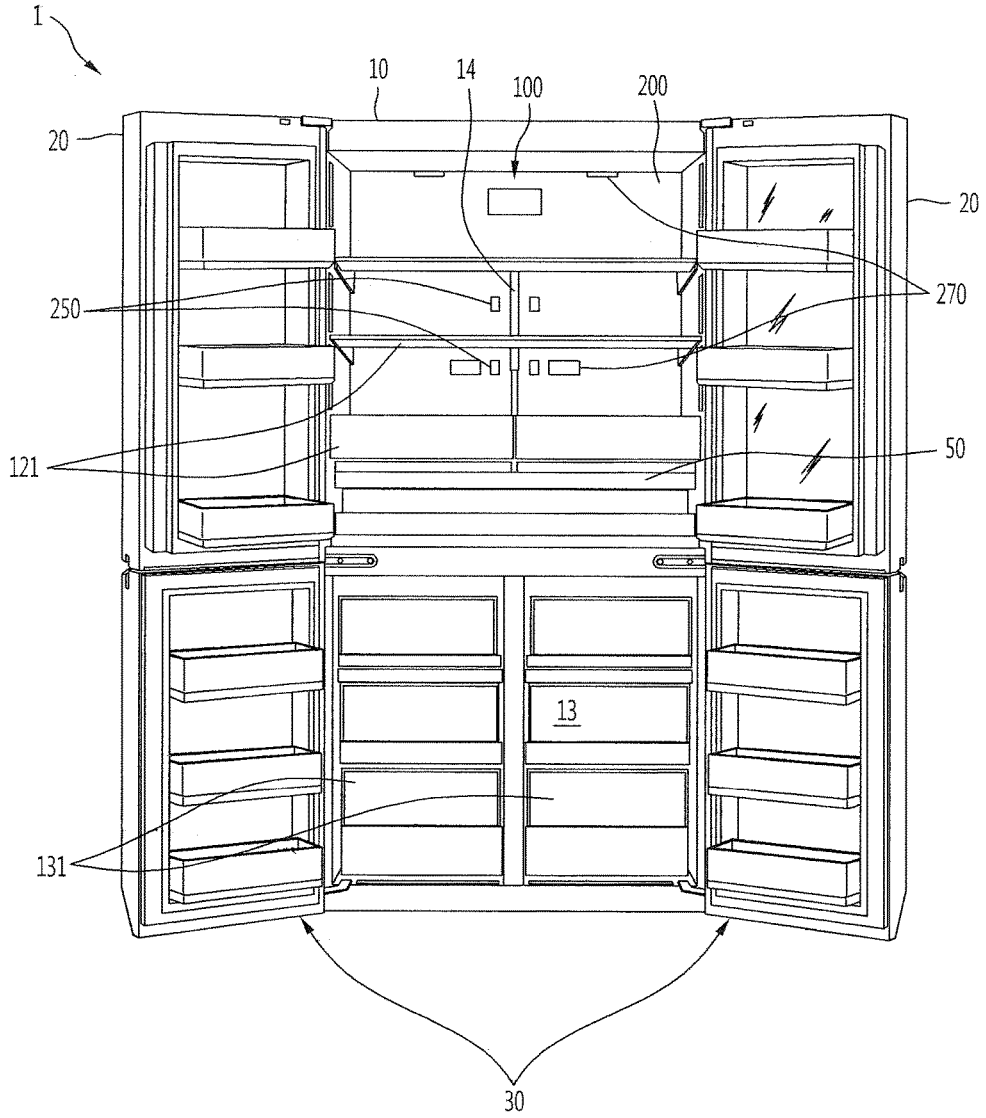
FIG. 1 is a front view illustrating a refrigerator, a door of which is opened according to an embodiment of the present disclosure.

FIG. 1 is a front view illustrating a refrigerator, a door of which is opened according to an embodiment of the present disclosure.

An outer appearance of a refrigerator 1 according to an embodiment of the present disclosure may be defined by a cabinet 10 that defines a storage space and a door that opens and closes the storage space.

The storage space may be vertically partitioned by a barrier 11, a refrigerating chamber 12 may be formed on the cabinet 10, and a freezing chamber 13 may be formed below the cabinet 10.

Further, various accommodation members 121 such as a shelf, a drawer and a basket may be formed inside the refrigerating chamber 12. The accommodation members 121 may be inserted or withdrawn while the door is opened, as needed, and may accommodate and store foods through the insertion and withdrawal.

Insertable and withdrawable drawer-shaped refrigerating chamber accommodating members 131 may be mainly arranged inside the refrigerating chamber, and these refrigerating chamber accommodating members 131 may be configured to be inserted and withdrawn in conjunction with opening of freezing chamber doors 30.

The door may include refrigerating chamber doors 20 and freezing chamber doors 30. The refrigerating chamber doors 20 may be configured to be opened and closed through pivoting a front opened surface of the refrigerating chamber 12, and the freezing chamber doors 30 may be configured to be opened and closed by pivoting a front opened surface of the freezing chamber 13. Further, the pair of refrigerating chamber doors 20 and the pair of freezing chamber doors 30 may be formed on left and right sides of the refrigerator 1 and may be configured to shield the refrigerating chamber 12 and the freezing chamber 13, respectively.

A plurality of door baskets may be formed in the refrigerating chamber doors 20 and the freezing chamber doors 30, and the door basket may be configured so as not to interfere in accommodation members that are provided inside the refrigerator in a state in which the refrigerating chamber doors 20 and the freezing chamber doors 30 are closed.

A cold air generating chamber having an evaporator 50 formed therein to generate cold air may be formed on an inner side of an inner wall of the storage space. Further, a cold air passage through which cold air generated in the cold air generating chamber is moved to the storage space and a cold air sucking passage through which the cold air within the storage space is moved to the cold air generating chamber may be formed on the inner wall of the storage space.

A purification device 100 for purifying the air within the storage space may be formed on the inner surface of the storage space. Further, the purification device 100 is provided to suck and purify the air within the storage space. Further, a purification passage through which the air purified by the purification device 100 is moved to the storage space may be formed on the inner side of the inner wall of the storage space. That is, the purification passage through which the air within the storage space is discharged to the storage space after being sucked and purified may be formed on the inner side of the inner wall of the storage space.

Meanwhile, a plurality of cold air generating chambers may be provided for the refrigerating chamber and the freezing chamber or only one cold air generating chamber may be provided to generate cold air that is supplied to the refrigerating chamber and the freezing chamber. Further, positions of the cold air passage, the cold air sucking passage and the purification device 100, which will be described in more detail below, on the inner wall of the storage space are not limited, and the technical spirit thereof may be applied to all storage spaces including the refrigerating chamber 12 and the freezing chamber 13.

Hereinafter, for convenience of description, a structure in which the cold air passage, the cold air sucking passage, and the purification device 100 are formed on a rear wall of the refrigerating chamber 12 will be described in detail.

The entirety or at least a portion of the rear wall of the refrigerating chamber 12 may be formed by a grill pan 200. The cold air passage may be formed on a rear side of the grill pan 200. Further, cold air discharge ports 270 through which cold air moved through the cold air passage is discharged may be perforated in the grill pan 200. The plurality of cold air discharge ports 270 may be vertically and horizontally formed in the grill pan 200.

Meanwhile, the purification device 100 for purifying air within the refrigerating chamber 12 may be formed on a rear wall surface of the refrigerating chamber 12. The purification device 100 may be provided to suck air within the refrigerating chamber 12 and remove odor. The purification device 100 may be formed on an inner side of the rear wall surface of the refrigerating chamber 12 and may be exposed to a front side of the grill pan 200.

Purification discharge ports 250 through which the air purified by the purification device 100 is discharged may be formed in the grill pan 200. Further, the purification passage through which the air purified by the purification device 100 is moved to the purification discharge ports 250 may be formed on the rear side of the storage space. A plurality of purification discharge ports 250 may be vertically and horizontally formed in the grill pan 200.

The purification passage and the cold air passage may be formed by a duct unit that is formed on the rear side of the grill pan 200.

Meanwhile, mounting member holders 14 that pass through the grill pan 200 and the duct unit 300 and are exposed to the refrigerating chamber 12 may be formed in the refrigerating chamber 12 to mount the accommodation members 121. The mounting member holders 14 may vertically extend from opposite left and right ends of the rear wall surface of the refrigerating chamber 12 and a central portion of a transverse width of the rear wall surface of the refrigerating chamber 12. Here, the cold air discharge ports 270 and the purification discharge ports 250 may be formed bilaterally symmetric to each other with respect to a mounting member holder 14.

Figure 2:
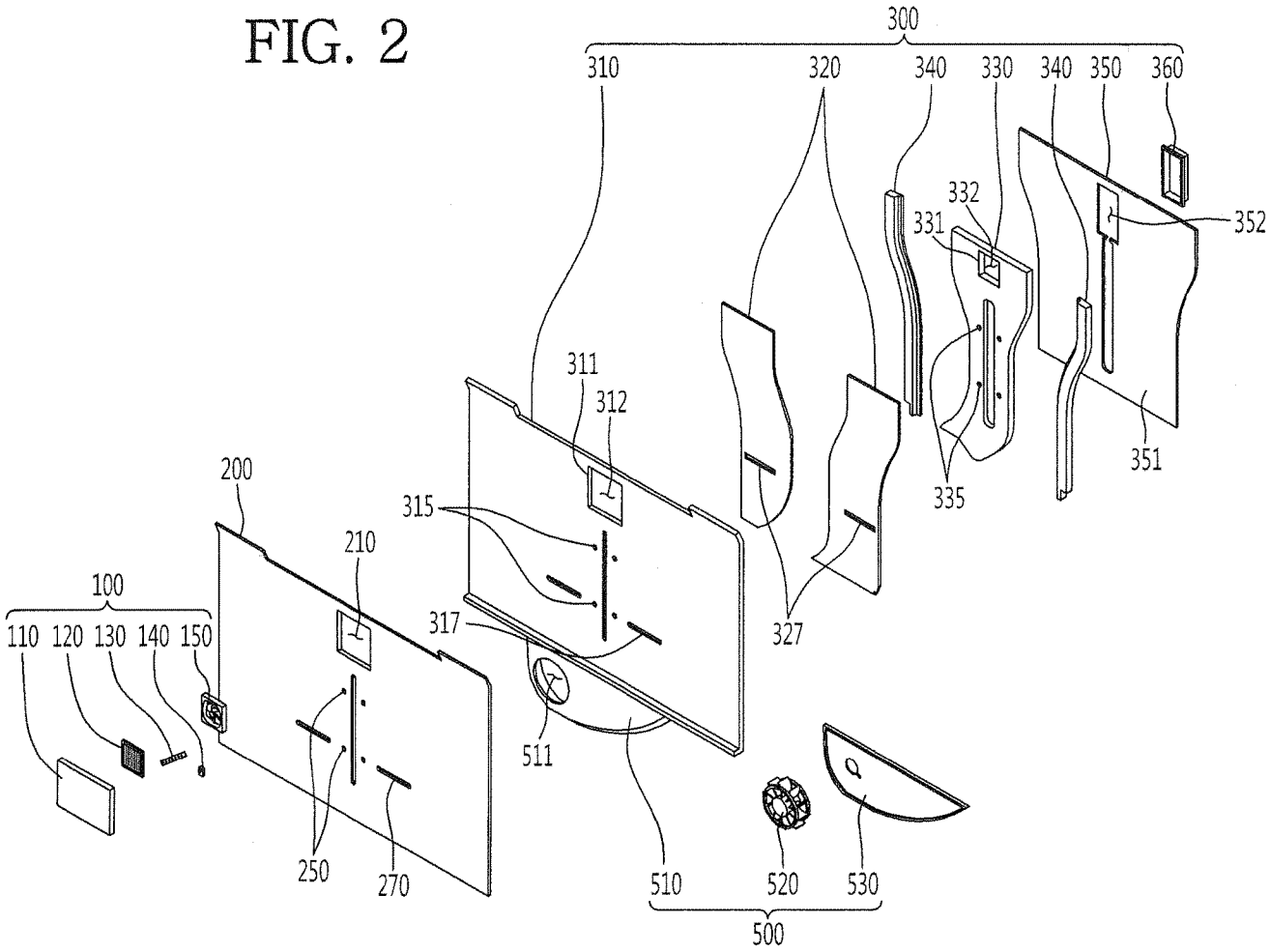
FIG. 2 is an exploded perspective view illustrating a state in which a grill pan, a duct unit, and a purification device are separated from each other according to the embodiment of the present disclosure.

FIG. 2 is an exploded perspective view illustrating a state in which a grill pan, a duct unit, and a purification device are separated from each other according to the embodiment of the present disclosure.

The purification device 100 may include a purification device cover 110 that covers internal elements of the purification device 100, a purification filter 120 that filters sucked air, and a purification fan 150 that provides a suction force for sucking air.

Further, the purification device 100 may further include an ultraviolet light emitting diode (LED) that sterilizes the sucked air and a sensor 140 that measures a pollution state of the air.

The purification device cover 110 may be provided to cover the internal elements of the purification device 100 and may be provided to define a passage through which air is sucked to purify the air within the refrigerating chamber 12.

The purification filter 120 is located on a path along which air that is sucked from a rear side of the purification device cover 110 is moved and is provided to purify the air. A deodorizing filter for removing odor may be used as the purification filter 120. Of course, a filter that filters bacteria and dusts may be complexly used as needed.

The purification fan 150 may be arranged on a rear side of the purification device cover 110. Further, the purification fan 150 may be provided to force movement of the air within the refrigerating chamber 12 to move the air to the refrigerating chamber 12 again after the air is purified. That is, by driving of the purification fan 150, the air that is sucked to the purification device 100 may be discharged to the refrigerating chamber 12 via the purification passage that is formed in the duct unit 300, after being purified through the purification filter 120.

The ultraviolet LED 130 is located on a path along which the air that is sucked from the rear side of the purification device cover 110 is moved. Thus, the ultraviolet LED 130 may provide a sterilizing effect to the sucked air.

Further, the sensor 140 may be provided to measure a pollution degree of the air within the refrigerating chamber 12. The sensor 140 may be formed on the rear side of the purification device cover 110 and be located adjacent to the purification fan 150 to measure the pollution degree of the sucked air as accurately as possible. The sensor 140 may be a gas sensor that detects odor molecules that is included in the air or may be provided as a sensor having a complex function that may measure also a concentration of foreign substances, such as dusts, that are included in the air.

The sensor 140 may be located outside the purification filter 120 in a state in which the purification filter 120 is arranged and may be exposed to air in a space between a cover panel 111 and the purification filter 120. Thus, the sensor 140 may be provided to measure a pollution degree of the air within the refrigerating chamber 12, which is not purified by the purification filter 120.

Further, the sensor 140 may be located as adjacent to the purification fan 150 as possible. Thus, the sensor 140 may be exposed to air that flows through driving of the purification fan 150, as much as possible, and may more accurately measure a pollution degree of the air.

Meanwhile, the grill pan 200 may be an approximately quadrangular plate that defines the rear wall surface of the refrigerating chamber 12. Further, a perforated purification device mounting port 210 may be formed on one side of the grill pan 200 such that the purification device 100 is inserted thereinto and the air within the refrigerating chamber 12 passes therethrough. The purification device 100 may be formed on an upper side of the refrigerating chamber 12 and the purification device mounting port 210 may be formed on the grill pan 200.

Further, the purification discharge ports 250 of the grill pan 200 may be formed below the purification device mounting port 210 and may be formed bilaterally symmetric to each other with respect to a transverse width of the grill pan 120. Further, the cold air discharge ports 270 may be formed on a lateral side of the purification discharge ports 250 to be spaced apart from the purification discharge ports 250 by a predetermined interval and may be formed bilaterally symmetric to each other with respect to the transverse width of the grill pan 120. Here, the purification discharge ports 250 may be formed adjacent to an approximately central portion of the transverse width of the grill pan 200 and the cold air discharge ports 270 may be located outside the purification discharge ports 250.

The duct unit 300 that defines the purification passage and the cold air passage may be formed on the rear side of the grill pan 200. The duct unit 300 may include a duct panel 310 that is formed on a rear surface of the grill pan 200, a purification duct 330 that is formed on a rear side of the duct panel 310 and defines the purification passage, cold air ducts 340 that are formed on a rear side of the duct panel 310 and define the cold air passage, and a duct cover 350 that shields the purification passage and the cold air passage on a rear side thereof and insulates the purification passage and the cold air passage from the outside.

Further, the duct unit 300 may further include heat insulating members 320 that are formed between the cold air passage and the duct panel 310 to insulate a conductive heat of cold air that flows through the cold air passage, and an air guide 360 that is mounted on the purification duct 330 to define at least a portion of the purification passage.

The duct panel 310 may be provided to have a shape and a size corresponding to the grill pan 200 and may be provided to be mounted on the grill pan 200. Further, the purification duct 330 may be mounted on a rear surface of the duct panel 310. The purification duct 330 may be located at a center of the duct panel 310 in a transverse width direction thereof.

A purification device mounting part on which the purification device 100 is mounted may be formed in the duct panel 310 and the purification duct 330. The purification device mounting part may include a first mounting part 311 that is formed in the duct panel 310 and a second mounting part 331 that is formed in the purification duct 330.

The first mounting part 311 and the second mounting part 331 may be formed at locations corresponding to the purification device mounting port 210. Further, a duct panel hole 312 that communicates with the purification device mounting port 210 may be formed in the first mounting part 311. Further, a purification duct hole 332 that communicates with the duct panel hole 312 may be formed in the second mounting part 331.

Thus, the purification device 100 may be exposed to the refrigerating chamber 12 and suck the air within the refrigerating chamber 12, through the purification device mounting port 210 in a state in which the purification device 100 is mounted to the purification device mounting part. Further, the air that is sucked by the purification fan 150 may pass through the purification device mounting port 210, the duct panel hole 312 and the purification duct hole 332. Further, the air that has passed through the purification duct hole 332 may be guided such that the air is moved to the refrigerating chamber 12 through the purification passage that is formed in the purification duct 330.

Meanwhile, first purification holes 315 may be formed in the duct panel 310 and second purification holes 335 may be formed in the purification duct 330. The first purification holes 315 and the second purification holes 335 may be provided to define a passage through which air in the purification passage that is formed in the purification duct is discharged to the refrigerating chamber 12. Thus, the first purification holes 315 and the second purification holes 335 may be formed at locations corresponding to the purification discharge ports 250 that is formed in the grill pan 200, to communicate with each other. That is, the air in the purification passage may be discharged to the refrigerating chamber 12 through the first purification holes 315, the second purification holes 335, and the purification discharge ports 250.

Meanwhile, the cold air ducts 340 that define the cold air passage may be formed on the rear surface of the duct panel 310. The cold air ducts 340 may be spaced apart from the purification duct 330 by a predetermined interval and the pair of cold air ducts 340 may be provided on opposite left and right sides of the purification duct 330, respectively. Further, the cold air passage may be formed in a space between the pair of cold air ducts 340. Further, the cold air passage may be partitioned into left and right parts by the purification duct 330.

Further, the cold air passage may communicate with the cold air discharge ports 270 of the grill pan 200. To achieve this, the cold air discharge ports 270 may be located inside an area of the cold air passage in the grill pan 200. Further, first cold air holes 317 are formed at locations corresponding to the cold air discharge ports 270 in the duct panel 310 to communicate the cold air discharge ports 270 and the cold air passage.

Meanwhile, the heat insulating members 320 may be formed in an area of the cold air passage and on the rear surface of the duct panel 310. That is, the heat insulating members 320 may be formed on the rear surface of the duct panel 310, which corresponds to a front surface of the cold air passage. Further, the heat insulating members 320 may be provided to have a shape corresponding to a shape of the cold air passage such that cold air in the cold air passage is not in direct contact with the rear surface of the duct panel 310. Further, the cold air that is moved through the cold air passage is not conducted to the duct panel 310 and the grill pan 200. Further, a problem that dew is formed as an outer surface of the grill pan 200 is overly cooled by the cold air in the cold air passage may be prevented.

Second cold air holes 327 may be formed at locations corresponding to the first cold air holes 317 in the heat insulating members 320, respectively. Thus, the cold air in the cold air passage may be moved to the refrigerating chamber 12 through the second cold air holes 327, the first cold air holes 317 and the cold air discharge ports 270.

The duct cover 350 may be formed on a rear side of the purification duct 330 and the cold air ducts 340. The duct cover 350 may be provided to have a size and a shape in which the purification duct 330 and the cold air duct 340 may be accommodated together. Further, the duct cover 350 may be provided to be in close contact with a rear surface of the purification duct 330 and a rear surface of the cold air duct 340 and may be provided to shield the purification passage and the cold air passage on a rear side thereof. That is, the duct cover 350 may be provided to define the rear surfaces of the purification passage and the cold air passage.

The duct cover 350 may be formed of a material having a heat insulating property such that the purification passage and the cold air passage are insulated from the outside.

Meanwhile, the air guide 360 may be formed on the rear surface of the purification duct 330. The air guide 360 may be provided to guide air purified through the purification device 100 such that the air is moved to the purification passage.

In detail, the air guide 360 may be provided to shield the purification duct hole 332 and the purification fan 150 on a rear side thereof and define a predetermined space on a rear side of the purification fan 150, which is shielded from the outside. Further, the air guide 360 may be provided to extend toward the purification passage such that the predetermined space on the rear side of the purification fan 150 communicates with the purification passage. Thus, the air that is sucked by the purification fan 150 is guided by the air guide 360 and is moved to the purification passage after being moved to a rear side of the purification fan 150.

Here, the air guide 360 may be provided to protrude rearward to define a predetermined space therein. Further, the duct cover 350 may have a duct cover hole 352 such that the air guide 360 is provided.

Meanwhile a cooling air fan assembly 500 that sucks cold air within the cold air generating chamber and moves the cold air to the cold air passage may be formed on one side of the duct unit 300. The cold air fan assembly 500 may be formed at a lower end of the duct unit 300.

The cold air fan assembly 500 may include a front fan cover 510, a cold air fan 520, and a rear fan cover 530. The front fan cover 510 and the rear fan cover 530 may be provided to define an accommodation space for the cold air fan 520 and to guide the cold air that is sucked by the cold air fan 520 to the cold air passage.

A fan cover hole 511 that communicates with the cold air generating chamber may be formed in the front fan cover 510. Thus, when the cold air fan 520 is driven, the cold air within the cold air generating chamber may be sucked into the cold air fan assembly 550 through the fan cover hole 511. Further, the cold air that is sucked by driving the cold air fan 520 may be moved to the cold air passage by the cold air fan assembly 500.

Figure 3:
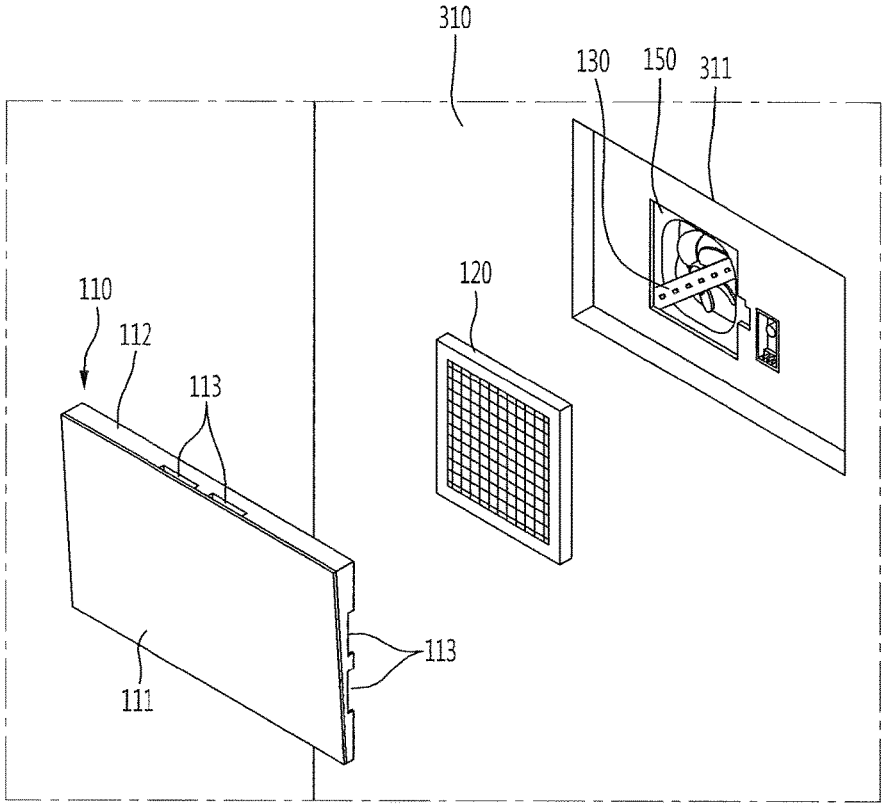
FIG. 3 is an exploded perspective view illustrating a structure of the purification device.

FIG. 3 is an exploded perspective view illustrating a structure of the purification device.

Referring to FIG. 3, the purification fan 150 may be mounted on the second mounting part 331 of the purification duct 330. Further, the purification fan 150 may be exposed such that air may be sucked through the duct panel hole 312.

The purification filter 120 may be arranged in front of the purification fan 150. The purification filter 120 may be formed to completely shield the duct panel hole 312. In detail, the purification filter 120 may be provided to have a size that is equal to or larger than that of the duct panel hole 312 and may be provided to have a shape corresponding to the duct panel hole 312. Thus, the air that is sucked by driving the purification fan 150 may always pass through the purification filter 120 to be purified.

Further, the ultraviolet LED 130 may be arranged in front of the purification fan 150. In detail, the ultraviolet LED 130 may be formed between the purification fan 150 and the purification filter 120. Further, the ultraviolet LED 130 may be formed to cross a space in front of the purification fan 150. That is, the ultraviolet LED 130 may be formed to cross the duct panel hole 312. Further, the purification fan 150 may be provided to cross the duct panel hole 312 in a diagonal direction so as to be in contact with the sucked air as much as possible.

Meanwhile, the sensor 140 may be mounted on the first mounting part 311 of the duct panel 310. The sensor 140 may be located adjacent to the purification fan 150 to measure the pollution degree of the sucked air as accurately as possible.

The purification device cover 110 may be arranged in front of the purification filter 120. The purification device cover 110 may include a cover panel 111 that defines a front surface of the purification device cover 110, a cover edge 112 that extends rearward from an end of a circumference of the cover panel 111, and purification suction ports 113 that is perforated such that air is sucked to the purification device 110.

The cover panel 111 may be provided to have a size that is equal to or larger than that of the purification device mounting part to completely shield the purification device mounting part on a front side thereof and may be provided to have a shape corresponding to the purification device mounting part. Thus, elements of the purification device 100 except for the purification device mounting part and the purification device cover 110 is not exposed to the refrigerating chamber 12 so as to form a clean outer appearance.

Further, the cover edge 112 extends rearward so that inner elements of the purification device 100 on a side thereof may not be exposed to the outside. Further, the cover edge 112 may space a rear surface of the cover panel 111 and the purification filter 120 apart from each other to define a space between the cover panel 111 and the purification filter 120.

Further, the purification suction ports 113 may be perforated to communicate with the space between the cover panel 111 and the purification filter 120. Thus, the air within the refrigerating chamber 12 may pass through the purification filter 120 after being sucked into the space between the cover panel 111 and the purification filter 120.

Further, the plurality of purification suction ports 113 may be formed along a circumference of the cover edge 112. In detail, upper portions, lower portions and opposite side portions of the cover edge 112 are opened so that the plurality of purification suction ports 113 may be formed. Thus, the air within the refrigerating chamber 12 may be sucked into the purification device 100 in various directions through the plurality of purification suction ports 113, so that the air may be more effectively purified.

Figure 4:
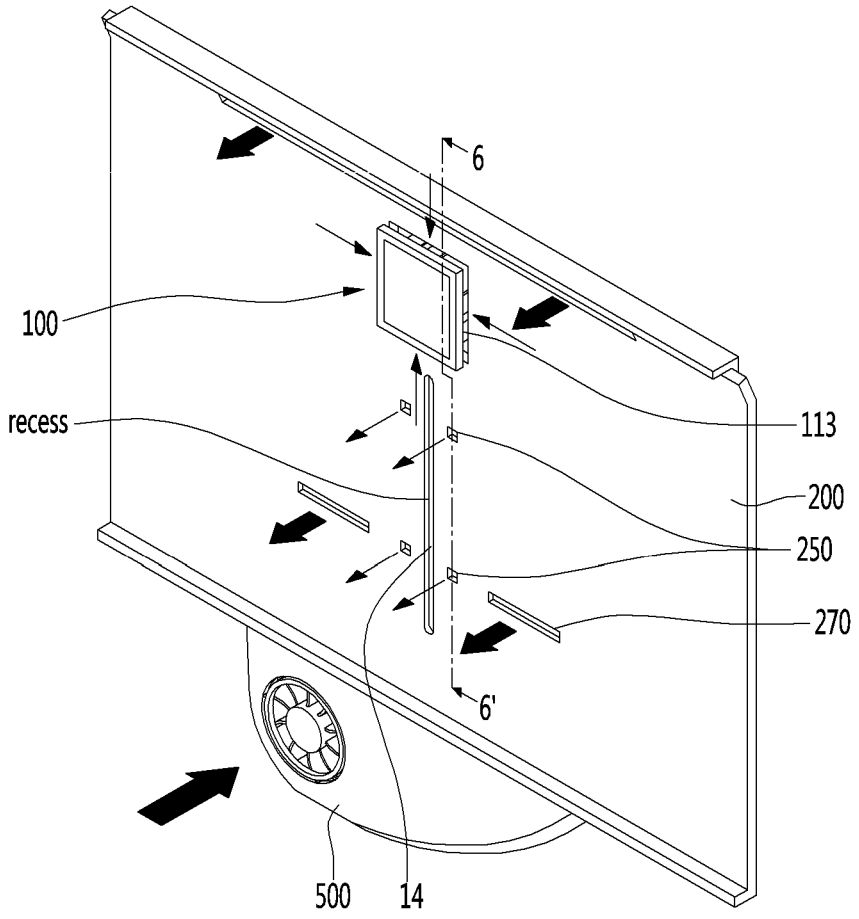
FIG. 4 is a perspective view illustrating a structure in which the grill pan, the duct unit and the purification device are coupled to each other and a state in which cold air and purified air are discharged.
Figure 5:
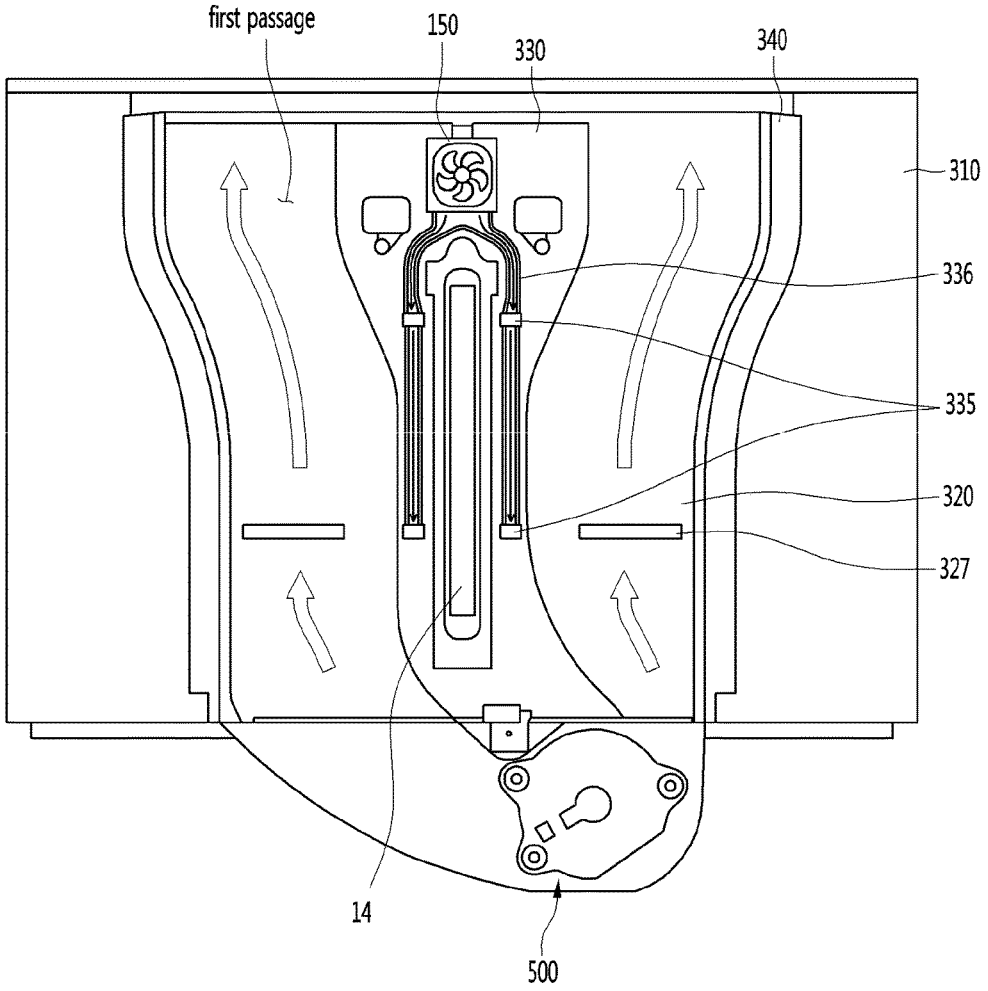
FIG. 5 is a rear view illustrating a structure of the duct unit of FIG. 4 when viewed from a rear side and a cold air passage and a purification passage.
Figure 6:
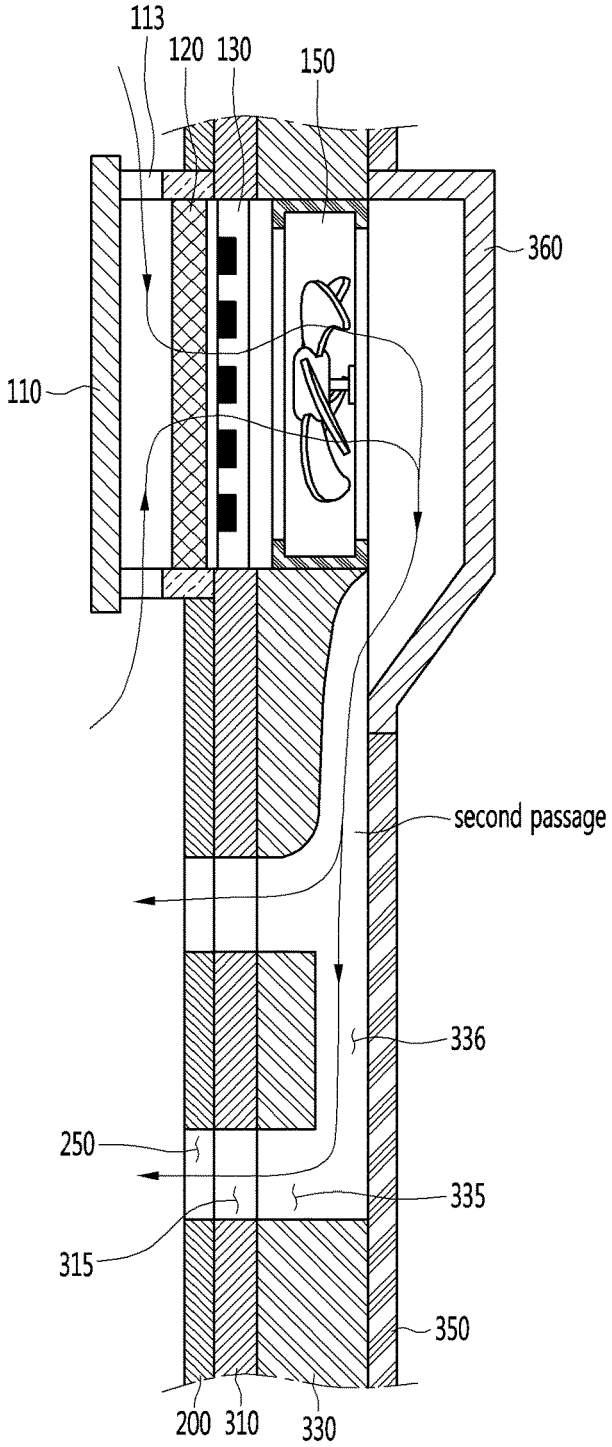
FIG. 6 is a sectional view illustrating a cross-section taken along line 6-6' of FIG. 4 and the purification passage.

FIG. 4 is a perspective view illustrating a structure in which the grill pan, the duct unit and the purification device are coupled to each other and a state in which cold air and purified air are discharged. Further, FIG. 5 is a rear view illustrating a structure of the duct unit of FIG. 4 when viewed from a rear side and the cold air passage and the purification passage. Further, FIG. 6 is a sectional view illustrating a cross-section taken along line 6-6' of FIG. 4 and the purification passage.

Hereinafter, the cold air passage and the purification passage will be described in detail with reference to FIGS. 4 to 6.

Referring to FIGS. 4 and 5, cold air sucked through the cold air fan assembly 500 is moved along the cold air passage that is formed between the purification duct 330 and the cold air duct 340. Here, the cold air is not in direct contact with the duct panel 310 by the heat insulating member 320. Further, the cold air may be moved to the refrigerating chamber 12 through the second cold air holes 327 and the cold air discharge ports 270.

Meanwhile, a purification passage part 336 that guides air sucked through the purification duct hole 332 to the second purification holes 335 may be formed on the rear surface of the purification duct 330. That is, the purification passage may be defined by the purification passage part 336. In detail, the purification passage part 336 may be recessed in the rear surface of the purification duct 330. Further, the purification passage part 336 may extend from one side of the purification duct hole 332 to pass through the second purification holes 335.

In more detail, an upper end of the purification passage part 336 may communicate with the purification duct hole 332. Further, the purification passage part 336 may extend from the purification duct hole 332 toward the second purification holes 335 and the second purification holes 335 may be located inside the purification passage part 336. Thus, the air sucked through the purification duct hole 332 is moved through the purification passage part 336 and is discharged to the second purification holes 335.

Meanwhile, the mounting member holder 14 may be located at a center of the rear wall surface of the refrigerating chamber 12 and the purification discharge ports 250 may be formed bilaterally symmetric to each other with respect to the mounting member holder 14. Here, the second purification holes 335 that communicates with the purification discharge ports 250 may be also formed bilaterally symmetric to each other at a center of a transverse width of the purification duct 330. Further, a hole through which the mounting member holder 14 passes may be formed between the second purification holes 335 at a center of the purification duct 330 in the transverse direction thereof. In this case, the purification passage part 336 may be divided into opposite left and right parts and extend downward such that the purification passage part 336 is spaced apart from the hole through which the mounting member holder 14 passes after communicating with the second purification holes 335.

Referring to FIGS. 4 to 6, when the purification fan 150 is driven, the air within the refrigerating chamber 12 may be sucked into the purification device 100 through the purification suction ports 113. Further, the sucked air may be purified while passing through the purification filter 120 and may be sterilized while passing through the ultraviolet LED 130.

Meanwhile, the air guide 360 is formed on the rear surface of the purification duct 330 and defines a space on a rear side of the purification fan 150, which is sealed from the outside. Further, the air guide 360 may extend towards the upper end of the purification passage part 336 such that the purified air is guided to the purification passage part 336 and may be provided to accommodate a portion of the upper end of the purification passage part 336. That is, the air guide 360 may be provided to define a passage that is sealed from the outside and communicates with the purification duct hole 332 and the purification passage part 336.

Thus, the air that is purified by the purification device 100 may be moved to the purification passage part 336 while being guided by the air guide 360. Further, the air that has been downwardly moved along the purification passage part 336 may be discharged to the refrigerating chamber 12 through the second purification holes 335, the first purification holes 335, and the purification discharge ports 250.

Hereinafter, an operation of the purification device 100 will be described in detail.

The air within the refrigerating chamber 12 may come into contact with the sensor through the purification suction ports 113 and the purification device mounting port 210.

Further, the purification device 100 may be operated based on a concentration of odor molecules included in the air within the refrigerating chamber 12.

To this end, the sensor 140 may be provided to convert the concentration of odor molecules included in the air into an electric signal and to read the electric signal. Further, the purification fan 150 may be controlled to be operated when the concentration of odor molecules, which is measured by the sensor 140, is not less than a predetermined reference value.

When the purification fan 150 is driven, the air within the refrigerating chamber 12 is sucked into the purification device 100 and is purified.

Meanwhile, the sensor 140 may be provided to consistently measure the concentration of odor molecules in the sucked air. Further, the purification fan 150 may be controlled so as not to be operated when the concentration of odor molecules, which is measured by the sensor 140, is lower than the predetermined reference value. Here, because the sensor 140 is located adjacent to the purification fan 150, the sensor 140 may more accurately measure the concentration of odor molecules.

Meanwhile, the purification fan 150 may be controlled to be operated at a specific time interval. That is, even when the sensor 140 is not provided or the concentration of odor molecules, which is measured by the sensor 140, does not arrive at the predetermined reference value, the purification fan 150 is periodically operated to maintain the air within the refrigerating chamber 12 in an optimum state.

According to the above-described embodiment of the present disclosure, the separate purification passage, which is distinguished from the cold air passage along which the cold air generated in the cold air generating chamber is moved, is formed. Further, the purification device 100 that moves the air within the storage space through the purification passage and purifies the moved air is formed. Thus, the air within the storage space may be independently and effectively purified without affecting the temperature of the storage space.

In the refrigerator according to the embodiment of the present disclosure, the purification device that sucks and purifies the air within the storage space is formed and the purification passage that is distinguished from the cold air passage is formed, so that the air within the storage space may be independently and effectively purified.

Further, the purification passage is formed distinguishably from the cold air passage, so that a problem that the inside of the storage space is excessively cooled by the cold air is prevented.

Further, when the duct unit that is formed on a rear side of the grill fan and defines the cold air passage is formed, the purification passage is formed in the duct unit, so that the space for formation of the purification passage may be minimized.

Further, the purification device is mounted on the purification device mounting part that communicates with the purification passage to purify air that is moved from the storage space to the purification passage.

Further, the purification duct is provided to partition the cold air passage, so that the cold air within the cold air passage is moved separately to left and right sides on a rear side of the storage space. Further, the cold air that flows through the cold air passage may be smoothly discharged to left and right sides of the storage space through the cold air discharge ports of the grill pan, so that cooling may be effectively performed.

Further, the purification duct is formed between the pair of cool air ducts, so that a volume of the duct unit may be minimized.

Further, the opened rear surface of the purification passage part is sealed by the duct cover, so that the purification passage that is sealed from the outside may be formed.

Further, the air guide is formed, so that the air that is sucked into the purification holes may be guided to the purification passage.

Further, the sucked air may be effectively sterilized by the ultraviolet LED that is arranged to cross the front surface of the purification fan.

Further, the sensor is formed adjacent to the purification fan on the side of the purification fan, so that the sensor may accurately measure the pollution degree of the air that is sucked by the purification fan.

Further, the purification fan is controlled to be operated based on the concentration of odor molecules, so that the air within the storage space may be maintained in a clean state of a predetermined level.

Further, the purification fan is controlled to be operated at a specific time interval, so that the air within the storage space may be maintained in a clean state of a predetermined level.

What is claimed is:

1. A refrigerator comprising:

a cabinet that includes an interior area;

an evaporator that is provided in the interior area and configured to cool a first portion of air in the interior area;

a grill pan that faces the interior area, the grill pan including a first discharge port and a second discharge port;

a purification device that is coupled to an upper portion of the grill pan and that is configured to (i) draw a second portion of the air from the interior area and (ii) purify the second portion of the air, the purification device including a suction port into which the second portion of the air is introduced and a purification fan;

a cold air duct that is disposed rearward of the grill pan and that is configured to guide the first portion of the air that has been cooled by the evaporator through a first passage;

a purification duct that is spaced apart from the cold air duct, the purification duct including (i) a duct hole communicated with the suction port and (ii) a second passage through which the second portion of the air passing through the purification fan flows to the interior area; and a cold air fan that is configured to provide the first portion of the air from the evaporator to the first passage, wherein the first passage is isolated from the second passage, wherein the cold air fan is located in a lower side of the grill pan such that the first portion of the air passing through the cold air fan flows upwardly and is discharged toward the interior area through the first discharge port, and wherein the suction port of the purification device is located above the second discharge port such that the second portion of the air passing through the purification fan flows downwardly and is discharged toward the interior area through the second discharge port.

2. The refrigerator of claim 1, further comprising:

a purification device mounting port that is provided at the grill pan and coupled to the purification device, and a purification device mounting part that is provided at the purification duct and coupled to the purification device.

3. The refrigerator of claim 1, wherein the purification duct is coupled to a central area of the grill pan and, wherein the cold air duct comprises a plurality of cold air ducts disposed at both sides of the purification duct.

4. The refrigerator of claim 1, further comprising:

a duct panel that is coupled to the grill pan, and a duct cover that is spaced apart from the duct panel, and wherein the purification duct and the cold air duct are located between the duct panel and the duct cover.

5. The refrigerator of claim 1, wherein the purification duct includes a purification passage part that is a recessed portion of the purification duct, wherein the refrigerator further comprises:

a duct cover that is coupled to a portion of the purification duct other than the purification passage part and that is spaced apart from the purification passage part, and wherein the second passage is at a space between the purification passage part and the duct cover.

6. The refrigerator of claim 5, further comprising:

an air guide that is coupled to the purification duct and that is configured to (i) receive the second portion of the air from the purification device and (ii) guide the second portion of the air to the purification passage part.

7. The refrigerator of claim 1, further comprising:

a heat insulating member that is coupled between the grill pan and the cold air duct and that is configured to block heat transfer between the grill pan and the cold air duct.

8. The refrigerator of claim 1, wherein the evaporator is located vertically below the grill pan.

9. The refrigerator of claim 1, wherein the cold air fan is configured to provide the first portion of the air to the first passage at a space between the purification duct and the cold air duct.

10. The refrigerator of claim 1, further comprising:

a mounting member holder that is configured to hold a shelf in the interior area, wherein the grill pan includes a recess into which the mounting member holder is inserted.

11. The refrigerator of claim 10, wherein the recess of the grill pan is isolated from the second passage.

12. The refrigerator of claim 1, wherein the purification device includes:

a purification filter that is located adjacent to the purification fan and that is configured to purify the first portion of the air, and a purification device cover that is located adjacent to the purification filter and that is configured to cover the purification fan and the purification filter.

13. The refrigerator of claim 12, wherein the suction port includes a plurality of purification suction ports disposed at a circumference of the purification device cover.

14. The refrigerator of claim 12, wherein the purification device further includes:

an ultraviolet light emitting device (LED) that is located between the purification filter and the purification fan and that is configured to sterilize the second portion of the air.

15. The refrigerator of claim 12, wherein the purification device further includes:

a sensor that is configured to obtain chemical information of the air in the interior area.

16. The refrigerator of claim 3, wherein the first passage is formed between the plurality of cold air ducts.

* * * * *